United States Patent [19]

Bokelmann

[11] 3,993,025

[45] Nov. 23, 1976

[54] MACHINE FOR THE CONTINUOUS REVERSE-COATING OF SHEET-FORM MATERIAL WITH POLYURETHANE FOAM

[75] Inventor: Horst Bokelmann, Bad Wildungen, Germany

[73] Assignee: Metzeler Schaum Gesellschaft mit beschrankter Haftung, Memmingen, Germany

[22] Filed: May 19, 1975

[21] Appl. No.: 578,921

[30] Foreign Application Priority Data

May 24, 1974 Germany ..... 2425008

[52] U.S. Cl. ..... 118/642; 118/202; 118/203; 118/259

[51] Int. Cl.[2] ..... B05C 1/08

[58] Field of Search ..... 156/78; 425/223; 118/641, 642, 643, 202, 203, 259, 261, 60

[56] References Cited

UNITED STATES PATENTS

| | | | |
|---|---|---|---|
| 3,032,815 | 5/1962 | Gerber | 425/223 X |
| 3,042,968 | 7/1962 | Kraszeske | 425/223 X |
| 3,239,367 | 3/1966 | Demeter | 118/202 X |
| 3,278,659 | 10/1966 | Willy | 156/78 X |
| 3,667,422 | 6/1972 | Saladin | 118/202 X |
| 3,682,133 | 8/1972 | Gomarin et al. | 118/202 |

*Primary Examiner*—John P. McIntosh
*Attorney, Agent, or Firm*—Michael J. Striker

[57] ABSTRACT

An installation for the continuous coating of sheet material with polyurethane foam includes a large diameter light weight rotating drum the outer surface of which is heated. A release agent and coating material is applied in thin superimposed layers to an upper portion of the drum. The sheet material to be coated is applied in tensioned condition to the remainder of the drum with the bottom face of the sheet material engaging the coating material so that the latter penetrates into the material and hardens, whereafter the sheet material is continuously withdrawn. The face of the sheet material which engages the coating material is preheated immediately upstream of the drum.

9 Claims, 4 Drawing Figures

MACHINE FOR THE CONTINUOUS REVERSE-COATING OF SHEET-FORM MATERIAL WITH POLYURETHANE FOAM

For numerous applications in the building, textile and upholstery industries, it is desirable to coat webs or sheets of a variety of different materials with polyurethane. Machines and industrial installations for the continuous coating of floor coverings with natural or synthetic latex are already known. Unfortunately, installations of this kind have the disadvantage that they are expensive both in terms of construction and also in terms of energy consumption. Added to this is the fact that coating installations of the kind used in the rubber industry are also unsuitable for coating with polyurethanes on account of the different reaction times involved.

In other known processes, the foam is applied to the woven sheet-form textile, and the sheet thus coated subsequently dried on a heated drum, as a result of which the layer of foam hardens. Unfortunately, processes of this kind are only suitable for coating sheet-form materials of narrow width. It is not possible by these processes uniformly to coat sheet-form material with a width of, for example, more than two meters, nor is any machine capable of coating widths of this order currently available.

Accordingly, the present invention relates to a machine or industrial installation for continuously treating sheet-form products of large surface area, but more especially for the reverse-coating or doubling of sheets of textile materials, plastics, foams, paper, leather and/or metal, with a uniform layer more than 2 meters wide, more especially more than 3 meters wide, preferably more than 4 meters wide, of polyurethane foam optionally containing standard fillers, the material to be treated or manufactured travelling through stages of this industrial installation in which it is heated, foamed, stabilized and collected.

The industrial installation according to the invention comprises a driven drum with a covering of glass-fibre-reinforced plastic, a metal reinforcing belt and an optionally smooth or profiled plastics surface. The drum, which is heated by an external heating system to between about 70° and 100° C, is preceded by tension rollers, a magazine for sheet-form material and an off-winding unit, associated with at least two mobile, infinitely variable intensive heating stages and with separate, jointly driven feed systems for the reaction mixture and release agent, with a doctor for the reaction mixture and with a distributor for the release agent, and followed by a take-off unit consisting of rollers, a trimming unit and a winding unit. Further embodiments of the invention, more especially the systems required for the practical application of the industrial installation, are characterised in the Subsidiary Claims.

The invention is illustrated by way of example in the accompanying drawings, wherein.

Figure 1:
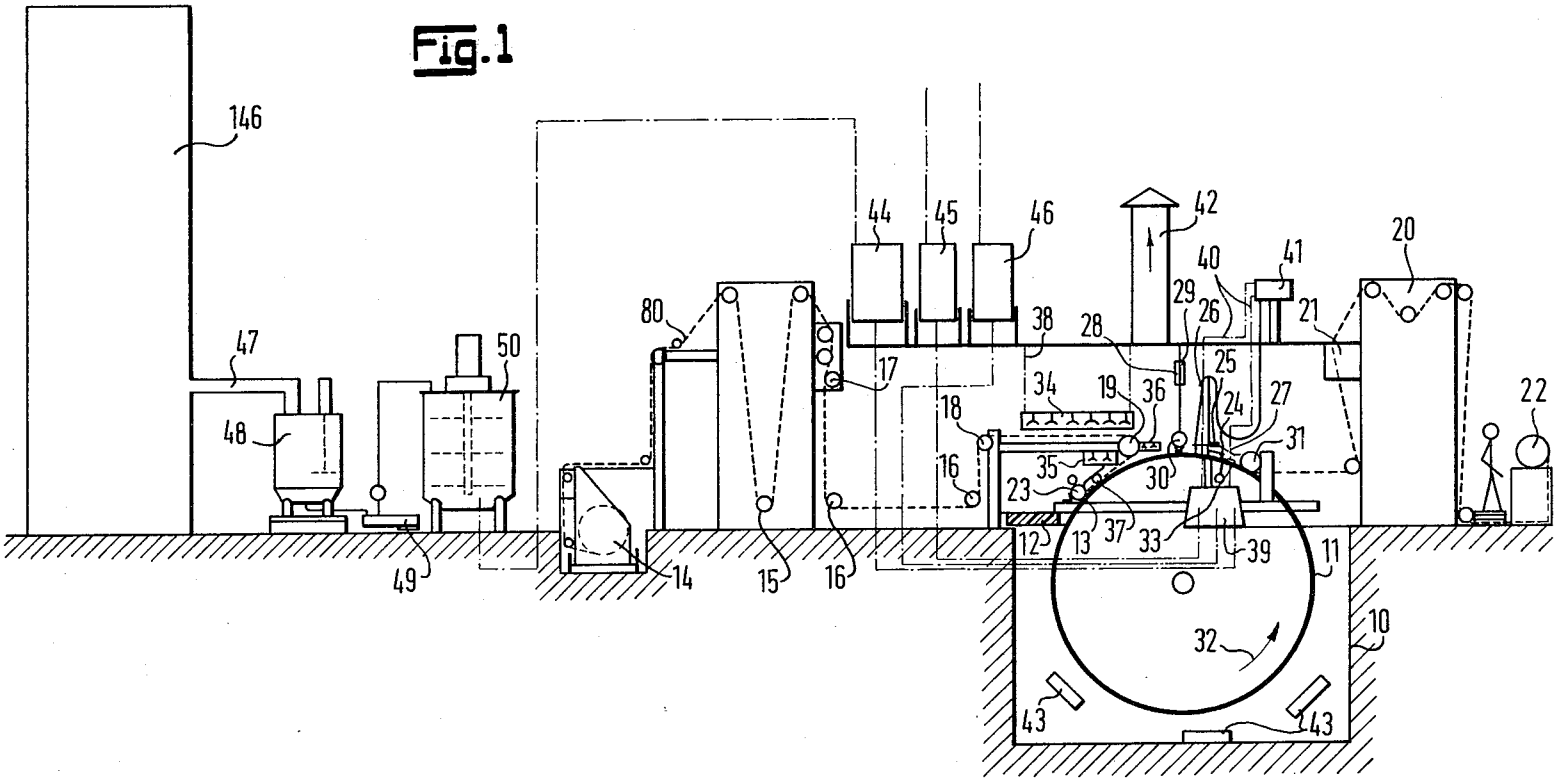
FIG. 1 is a diagrammatic view of the installation as a whole.

An installation for the reverse-coating of carpeting with polyurethane foam reaction mixture is described in the following:

The most important part of the installation shown in FIG. 1 is a hollow drum 11 which is located with a major portion thereof in a pit 10 and which is described in the following with reference to FIG. 2. The pit 10 is heat-insulated and is partly covered at its upper end by covers 12 and, at its sides, by elevated screens 13 in such a way that only the uppermost part of the cylindrical surface of the drum 11 projects from the pit. The drum 11 is preceded by a transversely displaceable sheet offwinding unit 14, a sheet magazine 15 of known type and by guide rollers 16, a sheet roller 17, tension rollers 18 and a sheet expander 19. The drum 11 is followed by another sheet magazine 20 with a trimming or edge-cutting unit 21 and a winding unit 22 for the end product. That part of the surface of the drum 11 projecting from the pit 10 has associated with it a friction drive 23 and a shuttle carriage 25 which is designed to travel longitudinally of the drum on a guide 24, carrying the feeder 26 for the reaction mixture and at the same time, facing away therefrom, the feeder 27 for a release agent (cf. FIG. 4).

The feeder for the reaction mixture is in the form of a hose 26 whose end opens immediately behind a doctor 30 which is vertically adjustable by means of a winch 28 and which is designed to be removed from the working zone on a transverse guide 29. The feeder 27 for the release agent is in the form of a spout which is combined with an applicator roll 31 with an elastic, porous surface which co-rotates on the surface of the drum 11 and provides for the satisfactory distribution of release agent. Behind the applicator roll 31, looking in the direction of rotation of the drum (arrow 32), a spreading bar 33 designed for oscillation is placed on the surface of the drum 11, smoothing the coating of release agent on the roller 31 and, optionally, texturing it in the form of a pattern. The spreading bar 33 is mounted on the guide 24 and is moved longitudinally of the drum by an eccentric drive (not shown in detail). It best has an elastic, porous and, hence, absorbent and, at the same time, wear-resistant bottom face. Three intensive heating stages 34, 35, 36 are provided above this part of the drum. The heating stage 34 is associated with the face of the material to be coated (sheet 80) over that section preceding the point at which the sheet runs onto the drum (reference 37). The heating stage 35 is arranged directly over the point at which the sheet 80 runs onto the drum, while the heating stage 36 is associated with that part of the surface of the drum situated between the doctor 30 and the point 37 at which the sheet runs onto the drum. All three heating stages are infinitely variable. In addition, the heating stage 34 is designed to be removed upwards from its range of activity by means of winches 38. The winches 38 are best controlled in such a way that the heating stage 34 is automatically moved upwards when the drum stops.

Laterally of the drum 11 there are metering units 39 for the reaction mixture and the release agent. Depending upon the type of reaction mixture and the number of its components to be mixed with one another, the metering units 39 communicate through pipes 40 with a mixer 41 preceding the feed hoses 26.

Above the surface of the drum projecting from the pit, there is an extractor 42 through which any gases and vapours formed and the heat escaping from the pit 10, despite the presence of the screens, are removed. The pit is heated by heating elements 43 which are associated in any number with the surface of the drum 11.

The metering units 39 receive the individual components from overhead containers 45 and 46 which in turn are connected through pipes to high-capacity overhead containers or, not shown. In addition to the overhead containers for the components of the reaction mixture, there is another overhead container 146 for fillers or additives to be introduced which, through a metering screw 47, feeds a first mixer 48 whose output pipe in turn leads to an intensive-mixing colloid mill 49. In the mixer 48, filler is mixed with one of the reaction components, the resulting mixture introduced into the colloid mill 49, transferred therefrom to a guide vessel 50 which communicates with the overhead container 44. The toothed colloid mill 49 is designed to function simultaneously as a metering and measuring facility for the throughput of components and filler.

Figure 2:
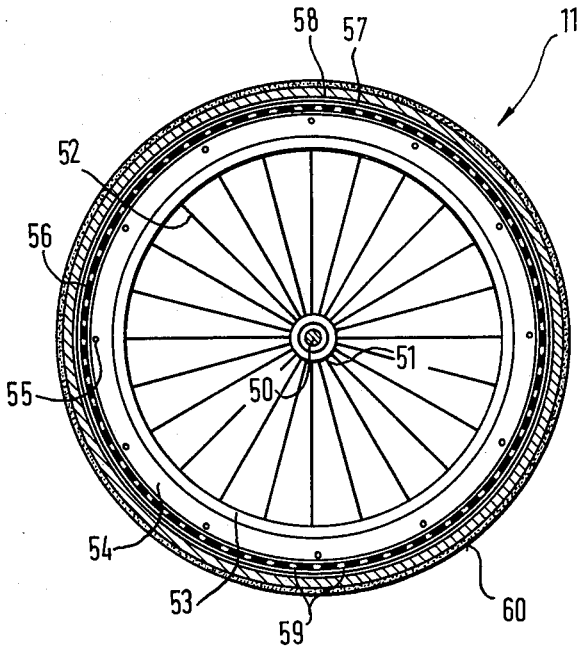
FIG. 2 is a cross-section through the drum.

FIG. 2 is a cross-section through the drum 11. Hubs 51 are fixed adjacent to both ends of a shaft 50, carrying both spokes 52 which, at their other outer ends, hold wheel rims 54 with inwardly directed flanges 53. During assembly of the drum, the wheel rims 54 are best held in position relative to one another by spacer members 55 which, after the drum has been assembled, may be removed again in order to save weight. Strips of glass fibre cloth, forming a first cylindrical surface 59, are placed adjacent one another or partly overlapping on the wheel rims 54 parallel to the shaft 50. The strips of glass fibre cloth are hardened by impregnation with a hardenable plastics or synthetic resin and are bonded to the wheel rims 54. Further impregnated strips of glass fibre cloth are bonded helically onto the cylindrical surface 59, increasing the thickness of the cylindrical surface 59 by another layer 56. A reinforcing belt 57 is then best placed on or embedded in the layer 56, again, and consisting in this embodiment of a spring steel wire. Above the reinforcing belt 57, there is a thin layer 58 of synthetic resin whose surface is best levelled and smoothed by a mechanical treatment, for example grinding, the thin layer 58 having applied to it, for special applications, another thin layer 60 formed with a negative or positive profile. In view of its large dimensions (diameter 5 meters, length 5 meters), the drum 11 is best assembled in the pit 10 itself, being designed in such a way that its rotation is only true and exactly cylindrical in a temperature range required for the subsequent operation of the installation. This result is readily obtained by ensuring that operating temperature prevails in the pit 10 during assembly of the drum.

Figure 3:
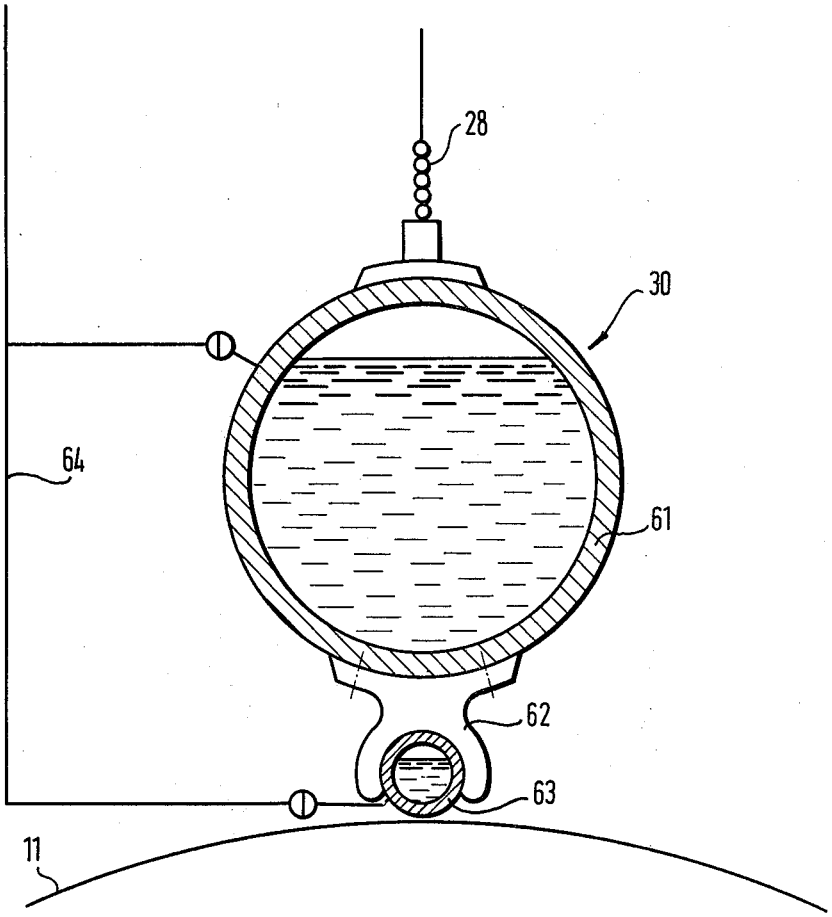
FIG. 3 is a cross-section through the doctor of the installation.

FIG. 3 is a cross section through the doctor 30 which consists of a rigid support 61, for example in the form of a hollow tube, and of a two-part tube 63 mounted on the bottom of the support 61 for displacement longitudinally thereof by means of thrust bearings 62. A coolant flows through the tube 61 and through the tube 63 by way of a pipe 64, while the winch 28 acts directly on the top of the tube 61, because it has been found that, with only one tube 61, distortion occurs under the effect of the heat generated by the reaction mixture, preventing uniform coating.

Figure 4:
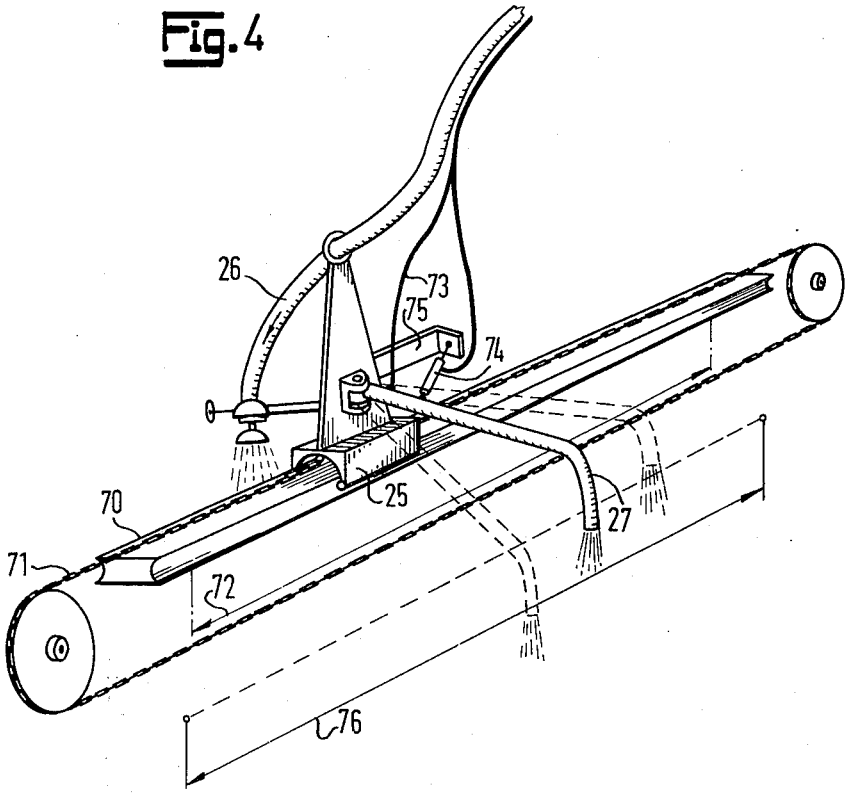
FIG. 4 shows that part of the installation comprising the feed systems for the reaction mixture and release agent.

Finally, FIG. 4 shows the feed system for the reaction mixture and the release agent. The shuttle carriage 25 is mounted to travel back and forth on a guide 70 by way of a chain drive 71, its travel 72 being adjustable to the particular zone in which reaction mixture and release agent are to be applied to the surface of the drum. The guide 70 is fixed at opposite ends to upper edges of the pit 10. The shuttle carriage 25 carries a hose 26 whose end opens directly onto the surface of the drum. The reaction mixture issues from the hose 26 in a uniform stream and, due to the rotation of the drum, builds up in front of the doctor 30 beneath which it passes in a layer of adjustable thickness. At its other side, i.e., at its side opposite to the hose 26, the shuttle carriage 25 has pivotally connected to it a tube section 27 which forms the feeder for the release agent pumped in through a hose 73. Through a working cylinder 74 which, at its other end, is mounted on a fixed bracket 75 on the shuttle carriage 25, the tube section 27 is pivoted and moved in such a way that it is able to cover a zone 76 exceeding the travel 72 of the shuttle carriage. It is possible in this way to prevent the reaction mixture from soiling the surface of the drum in the event of lateral overflow, and hence interfering with the operation of the installation.

The installation according to the invention operates as follows:

After the pit 10 has been heated, with the drum 11 rotating, to the working temperature for reverse-coating with polyurethane foam of from 60° to 100° C, a so-called "leader" section of the sheet form material is introduced by the offwinding unit 14, being looped around the drum 11 and guided up to the collecting stage 22. In the meantime, the pretreated components of the reaction mixture and release agent have arrived in the metering units 39. When the individual stages of the installation are cooperating with one another, as determined by the leader, the beginning of the material 80 to be coated is stitched onto the end of the leader and introduced into the installation in such a way that its bottom face runs onto the surface of the drum. The heating stages 34, 35 and 36 are already switched on, so that the bottom face of the sheet 80 is heated by the time it reaches the entry zone 37 which is also heated. There then begins the distribution of the release agent and the application of the reaction mixture which builds up in front of the doctor 30. During the movement of the sheet placed on the layer of reaction mixture around the heated drum, some of the gradually hardening reaction mixture enters the material to be coated, in the present case carpeting, so that, on the one hand, the pile or fibre "roots" are anchored while, on the other hand, the reaction mixture is firmly bonded to the bottom face of the sheet 80. During its movement around the drum 11, the reaction mixture hardens to such an extent that, at the take-off roller, it is lifted off the surface of the drum together with the sheet and the layer of release agent, and the finished sheet is cut, trimmed and wound into roll form at the collecting stage 22.

The coating may be applied in the form of a relatively thick or relatively thin, relatively firm or relatively loose layer, depending upon the speed of rotation of the drum, the width of the doctor gap and the composition of the reaction mixture.

The coating of release agent required for satisfactory separation requires extreme precision, the layer thickness of release agent amounting to only about 0.01 mm. The release agent, applied in the form of a dissolved wax, is brought to this uniform thickness through the applicator roll 27 and the spreading bar 33 and, until it runs in below the reaction mixture piling up in front of the doctor 30, develops in the form of a solid layer on the surface of the drum through evaporation of the solvents. As already mentioned, it is possible, through the spreading bar, to produce a pattern in the hardening wax which subsequently appears on the back of the coated carpet in the form of a silk-like, aesthetically pleasing finish.

In the event of stoppage of the installation, the heating stage 34 is not only switched off, but is also automatically raised, so that the sheet 80 to be coated cannot be overheated or burnt. For cleaning or maintenance, the doctor 30 may be completely removed from its working zone through the transverse guide 29.

In the event of stoppage of the installation, the shuttle carriage 25 is also automatically moved beyond its adjusted range of travel 72 to one of the two ends where collectors are provided both for the reaction mixture and also for the release agent, preventing the surface of the drum and, hence, the installation from being soiled or clogged by the afterflow or follow-up of reaction mixture or release agent.

It is of course also possible with this installation to coat sheet-like products other than carpeting.

In another possible application, it may be used for producing a continuous sheet of predetermined thickness from the reaction mixture, in which case the sequence of operations is such that, to begin with, a leader section is passed through the installation, although it subsequently ends, leaving only the coating composition to be run off and collected in the form of a sheet.

In another possible application of the installation according to the invention, dye or printing ink is applied to the layer of release agent between the point at which the release agent is applied and the point at which the reaction mixture is poured on, being subsequently reproduced in the form of a coloured pattern or print on the sheet to be coated or on the sheet of reaction mixture. Alternatively, it is also possible to apply a so-called release agent lacquer which performs both functions insofar as it acts both as a release agent and as a dye. In this case, the lacquer is left as a print or coloured pattern on the coated sheet or on the sheet of reaction mixture, similar to a linoleum.

It has been found tht it is only due to the effect the intensive heating stages 34, 35 and 36 or through the encircling sheet that a temperature equilibrium is established, enabling a high output to be reached after a certain warm-up period. At the present time, the upper limit to output in the case of sheets approximately 5 meters wide is 8 meters per minute, although an even higher output can be obtained with the aid of further attachments and by suitably preparing the mixture. It is even possible, by using an even more effective release agent and/or a solid, non-adhering coating on the surface of the drum, to reduce the coating of expensive release agent to a thickness of even less than 0.01 mm.

I claim:

1. In an installation for coating sheet material, a combination comprising, a driven large diameter light weight drum having a peripheral wall formed of glass fiber reinforced plastic material, endless metal reinforcements embedded in said plastic material, and a thin layer of plastic material surrounding said glass fiber reinforced plastic material; means for applying coating material in a layer of predetermined thickness to an upper peripheral surface of said drum; means for continuously applying the sheet material in tensioned condition to the coated peripheral surface of the drum so that the sheet material engages with one face thereof the layer of coating material whereby the latter penetrates into the sheet material; first heating means upstream of said drum for heating said face of the sheet material immediately before it contacts the coating material on the drum; second heating means surrounding at least part of the peripheral surface of the drum to which the sheet material is applied so that the coating material penetrating the sheet material hardens; and means for continuously withdrawing the coated sheet material from the drum.

2. A combination as defined in claim 1, and including third heating means adjacent the upper surface of the drum, trailing in the direction of rotation of the latter said coating applying means, for heating the coating material before it is contacted by the sheet material, and fourth heating means located immediately behind, as considered in direction of rotation of the drum, the line of contact of the sheet material with the coating material.

3. A combination as defined in claim 2, wherein the intensity of the first, third and fourth heating means is infinitely variable independently of each other.

4. A combination as defined in claim 2, wherein said first, third and fourth heating means comprise infrared heating elements.

5. A combination as defined in claim 1, wherein said drum is rotatably mounted in a pit so that only said upper peripheral surface portion projects upwardly beyond said pit, said second heating means being located in said pit, and including heat shield means connected to the upper edge of said pit and extending towards the peripheral surface of said drum for reducing heat losses.

6. In an installation for coating sheet material, a combination comprising, a driven large diameter light weight drum; means for applying coating material in a layer of predetermined thickness to an upper peripheral surface portion of said drum and comprising first feeding means movable in axial direction of said drum, and a doctor located rearwardly of said feeding means, as considered in the direction of rotation of said drum, and means for adjusting said doctor toward and away from the peripheral surface of said drum, said doctor comprising a rigid cooled supporting tube extending parallel to the axis of said drum, a cooled doctor element downwardly spaced from and parallel to said supporting tube, and bearing means mounting said doctor element for displacement in longitudinal direction parallel to the drum axis; means for continuously applying the sheet material in tensioned condition to the coated peripheral surface of the drum so that the sheet material engages with one face thereof the layer of coating material whereby the latter penetrates into the sheet material; first heating means upstream of said drum for heating said face of the sheet material immediately before it contacts the coating material on the drum; second heating means surrounding at least part of the peripheral surface of the drum to which the sheet material is applied so that the coating material penetrating the sheet material hardens; and means for continuously withdrawing the coated sheet material from the drum.

7. In an installation for coating sheet material, a combination comprising, a driven large diameter light weight drum; means for applying coating material in a layer of predetermined thickness to an upper peripheral surface portion of the drum and comprising first feeding means movable in axial direction of said drum, second feeding means for feeding a releasing agent onto a peripheral surface portion of the drum which is located upstream, as considered in the direction of rotation of the drum, of that surface portion onto which said coating material is applied by said first feeding means, a doctor located rearwardly of said first and second feeding means, as considered in the direction of rotation of said drum, means for adjusting the position of said doctor toward and away from the peripheral drum surface, a carriage mounting said first and second feeding means, elongated guide means extending parallel to the drum axis for guiding said carriage, means connected to said carriage for reciprocating the latter along said guide means, said second feeding means comprising a pipe mounted on said carriage for tilting movement about an axis transverse to the elongation of said guide means, and means for tilting said pipe about said transverse axis so that the releasing agent emanating from said second feeding means will cover a range exceeding the range of travel of said carriage; means for continuously applying the sheet material in tensioned condition to the coated peripheral surface of the drum so that the sheet material engages with one face thereof the layer of coating material whereby the latter penetrates into the sheet material; first heating means upstream of said drum for heating said face of the sheet material immediately before it contacts the coating material on the drum; second heating means surrounding at least part of the peripheral surface of the drum to which the sheet material is applied so that the coating material penetrating the sheet material hardens; and means for continuously withdrawing the coated sheet material from the drum.

8. A combination as defined in claim 7, and including an applicator roll having a porous, absorbent and elastic surface contacting the peripheral surface of the drum and being arranged upstream adjacent the outlet of said pipe so that the releasing agent emanating from said outlet is transmitted to the surface of said applicator roll.

9. A combination as defined in claim 8, and including an oscillating spreading bar having a porous, elastic bottom face in contact with the peripheral surface of the drum and being arranged downstream of said applicator roll, as considered in the direction of rotation of said drum.

* * * * *